US006843711B1

(12) United States Patent
Muldowney

(10) Patent No.: US 6,843,711 B1
(45) Date of Patent: Jan. 18, 2005

(54) CHEMICAL MECHANICAL POLISHING PAD HAVING A PROCESS-DEPENDENT GROOVE CONFIGURATION

(75) Inventor: Gregory P. Muldowney, Glen Mills, PA (US)

(73) Assignee: Rohm and Haas Electronic Materials CMP Holdings, Inc, Wilmington, DE (US)

( * ) Notice: Subject to any disclaimer, the term of this patent is extended or adjusted under 35 U.S.C. 154(b) by 0 days.

(21) Appl. No.: 10/734,795

(22) Filed: Dec. 11, 2003

(51) Int. Cl.[7] ..... B24B 7/22

(52) U.S. Cl. ..... 451/527; 451/921; 451/533; 451/537

(58) Field of Search ..... 451/527, 530, 451/533, 537, 538, 921; 51/296, 297

(56) References Cited

U.S. PATENT DOCUMENTS 5,020,283 A 6/1991 Tuttle
5,645,469 A 7/1997 Burke et al.
5,690,540 A * 11/1997 Elliott et al. ..... 451/41
5,921,855 A 7/1999 Osterheld et al.
5,990,012 A 11/1999 Robinson et al.
6,159,088 A 12/2000 Nakajima
6,273,806 B1 8/2001 Bennett et al.
6,354,919 B2 3/2002 Chopra
6,520,847 B2 2/2003 Osterheld et al.
6,685,548 B2 * 2/2004 Chen et al. ..... 451/526
6,783,436 B1 * 8/2004 Muldowney ..... 451/41

* cited by examiner

*Primary Examiner*—George Nguyen
(74) *Attorney, Agent, or Firm*—Blake T Biederman

(57) ABSTRACT

A polishing body, e.g., pad (200, 230, 260, 300) or belt (400, 500) having a polishing layer (214, 404) that includes a backmixing region (202, 232, 262, 308, 416, 508) wherein backmixing can occur within a slurry (116) between a wafer (204, 234, 264, 304, 408), or other article, and the polishing layer under certain conditions. The polishing layer includes a first groove configuration (206, 236, 266, 312, 428, 504) within the backmixing region and a second grove configuration (208, 238, 268, 320, 432, 520) outside of the backmixing region that is different from the first groove configuration. The first groove configuration is designed based upon whether or not the presence of spent slurry within the backmixing region is detrimental or beneficial to polishing the wafer.

10 Claims, 6 Drawing Sheets

CHEMICAL MECHANICAL POLISHING PAD HAVING A PROCESS-DEPENDENT GROOVE CONFIGURATION

BACKGROUND OF THE INVENTION

The present invention generally relates to the field of chemical mechanical polishing. More particularly, the present invention is directed to a chemical mechanical polishing pad having a process-dependent groove configuration.

In the fabrication of integrated circuits and other electronic devices, multiple layers of conducting, semiconducting and dielectric materials are deposited onto and etched from a surface of a semiconductor wafer. Thin layers of conducting, semiconducting and dielectric materials may be deposited by a number of deposition techniques. Common deposition techniques in modem wafer processing include physical vapor deposition (PVD), also known as sputtering, chemical vapor deposition (CVD), plasma-enhanced chemical vapor deposition (PIECED) and electrochemical plating. Common etching techniques include wet and dry isotropic and anisotropic etching, among others.

As layers of materials are sequentially deposited and etched, the uppermost surface of the wafer becomes non-planar. Because subsequent semiconductor processing (e.g., photolithography) requires the wafer to have a flat surface, the wafer needs to be planarized. Planarization is useful for removing undesired surface topography as well as surface defects, such as rough surfaces, agglomerated materials, crystal lattice damage, scratches and contaminated layers or materials.

Chemical mechanical planarization, or chemical mechanical polishing (CMP), is a common technique used to planarize workpieces, such as semiconductor wafers. In conventional CMP using a dual-axis rotary polisher, a wafer carrier, or polishing head, is mounted on a carrier assembly. The polishing head holds the wafer and positions the wafer in contact with a polishing layer of a polishing pad within the polisher. The polishing pad has a diameter greater than twice the diameter of the wafer being planarized. During polishing, each of the polishing pad and wafer is rotated about its concentric center while the wafer is engaged with the polishing layer. The rotational axis of the wafer is offset relative to the rotational axis of the polishing pad by a distance greater than the radius of the wafer such that the rotation of the pad sweeps out a ring-shaped "wafer track" on the polishing layer of the pad. The width of the wafer track is equal to the diameter of the wafer when the only movement of the wafer is rotational. However, in some dual-axis polishers, the wafer is oscillated in a plane perpendicular to its axis of rotation. In this case, the width of the wafer track is wider than the diameter of the wafer by an amount that accounts for the displacement due to the oscillation. The carrier assembly provides a controllable pressure between the wafer and polishing pad. During polishing, a slurry, or other polishing medium, is flowed onto the polishing pad and into the gap between the wafer and polishing layer. The wafer surface is polished and made planar by chemical and mechanical action of the polishing layer and slurry on the surface.

The interaction among polishing layers, polishing slurries and wafer surfaces during CMP is being increasingly studied in an effort to optimize polishing pad designs. Most of the polishing pad developments over the years have been empirical in nature. Much of the design of polishing surfaces has focused on providing these surfaces with various patterns of voids and networks of grooves that are claimed to enhance slurry utilization and polishing uniformity. Over the years, quite a few different groove and void patterns and configurations have been implemented. Prior art groove patterns include radial, concentric circular, Cartesian grid and spiral, among others. Prior art groove configurations include configurations wherein the depth of all the grooves are uniform among all grooves and configurations wherein the depth of the grooves varies from one groove to another.

Some designers of rotational CMP pads have disclosed pads having grooves of two or more configurations that change from one configuration to another based on one or more radial distances from the center of the pad. These pads are touted as providing superior performance in terms of polishing uniformity and slurry utilization, among other things. For example, in U.S. Pat. No. 6,520,847 to Osterheld et al., Osterheld et al. disclose several pads having three concentric ring-shaped regions, each containing a configuration of grooves that is different from the configurations of the other two regions. The configurations vary in different ways in different embodiments. Ways in which the configurations vary include variations in number, cross-sectional area, spacing and type of grooves.

Although pad designers have heretofore proposed CMP pads that include two or more groove configurations that are different from one another based on one or more radial distances from the concentric centers of such pads, these designs do not directly consider the rotational rates of the wafer being polished and the pad. Consequently, there is a need for CMP polishing pad designs that are optimized, at least in part, based on the rotational rate of the article being polished and the rate the pad is moved relative to the article.

SUMMARY OF THE INVENTION

In a first aspect of the present invention, a polishing pad for polishing an article rotated at a predetermined first rotational rate about a first rotational axis, comprising: (a) a polishing layer operatively configured to be moved at a predetermined rate relative to the first rotational axis, the polishing layer comprising: (i) a boundary located at 0.5 to 2 times the critical radius calculated as a function of the predetermined first rotational rate of the article and the predetermined rate of the polishing layer, the boundary having a first side and a second side opposite the first side; (ii) a first set of grooves located on the first side of the boundary and having a first configuration; and (iii) a second set of grooves located on the second side of the boundary and having a second configuration different from the first configuration.

In a second aspect of the present invention, a method of making a polishing pad having a polishing layer for polishing an article rotated at a predetermined first rotational rate about a first rotational axis while the polishing layer is moved at a predetermined rate relative to the first rotational axis, the method comprising the steps of: (a) determining the location of a boundary on the polishing layer at 0.5 to 2 times the critical radius calculated as a function of the predetermined first rotational rate of the article and the predetermined rate of the polishing layer; (b) providing a first set of grooves of a first configuration to the polishing layer on a first side of the boundary; and (c) providing a second set of grooves of a second configuration different from the first configuration on a second side of the boundary opposite the first side.

DETAILED DESCRIPTION OF THE INVENTION

Figure 1:
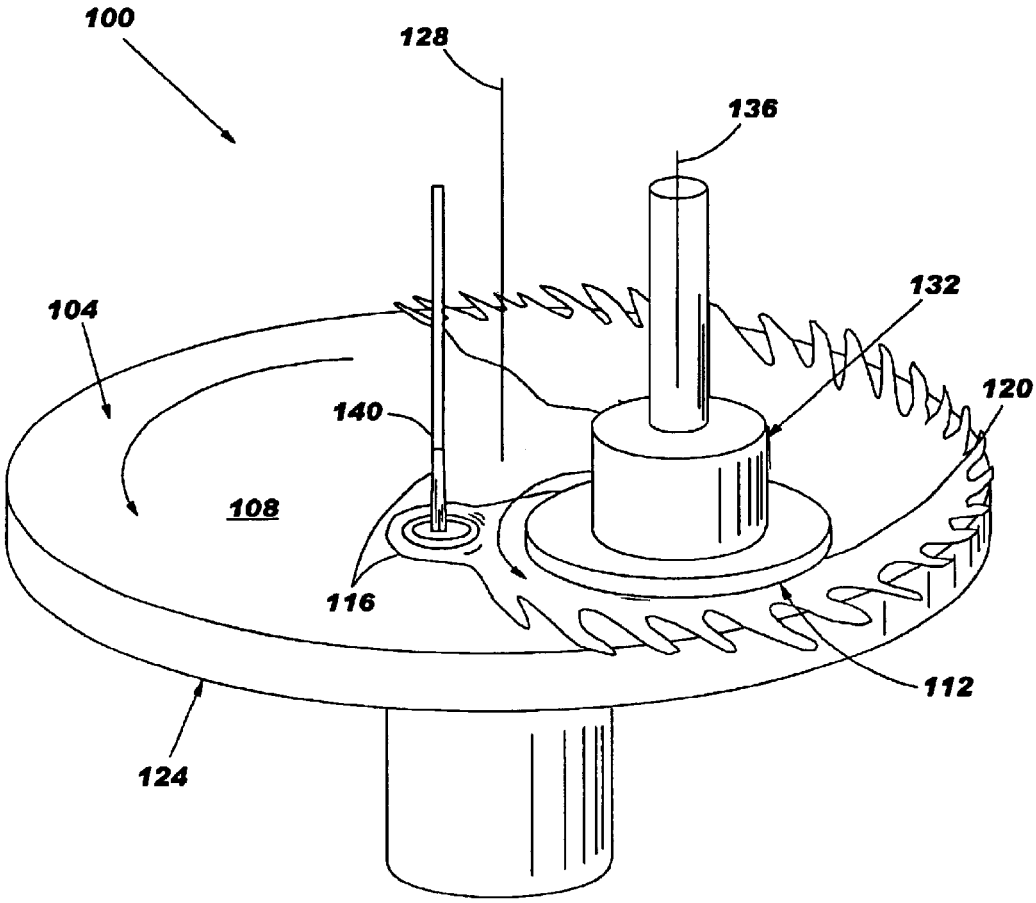
FIG. 1 is a perspective view of a portion of a dual-axis polisher suitable for use with the present invention.

Referring now to the drawings, FIG. 1 shows a dual-axis chemical mechanical polishing (CMP) polisher 100 suitable for use with the present invention. Polisher 100 generally includes a polishing pad 104 having a polishing layer 108 for engaging an article, such as semiconductor wafer 112 (processed or unprocessed) or other workpiece, e.g., glass, flat panel display or magnetic information storage disk, among others, so as to effect polishing of the polished surface of the workpiece in the presence of a slurry 116 or other polishing medium. For the sake of convenience, the terms "wafer" and "slurry" are used below without the loss of generality. In addition, for the purpose of this specification, including the claims, the terms "polishing medium" and "slurry" do not exclude abrasive-free and reactive-liquid polishing solutions.

As discussed below in detail, the present invention includes providing polishing pad 104 with a groove configuration that depends on the type of CMP process that will be performed with the pad. In one embodiment, if the presence of spent slurry (116) between wafer 112 and polishing pad 104 is detrimental to polishing, the pad may include a certain groove configuration in the region most affected. In another embodiment, if one or more polishing byproducts present within the spent slurry are beneficial to polishing, polishing pad 104 may include a different groove configuration in the affected region. The design of each groove configuration is based on the occurrence of "backmixing" within slurry 116 in the region between polishing pad 104 and wafer 112 where the rotational direction of the wafer is generally opposite the rotational direction of the polishing pad.

In general, backmixing is a condition that can occur within slurry 116 between polishing pad 104 and wafer 112 when the velocity, or component thereof, of the slurry between the pad and wafer is opposite in direction to the tangential velocity of the polishing pad and has a magnitude sufficiently large. Slurry 116 on polishing layer 108 outside the influence of wafer 112 generally rotates at the same speed as polishing pad 104 at steady state. However, when slurry 116 contacts polished surface 120 of wafer 112, adhesive, frictional and other forces due to the interaction of the slurry and the polished surface will cause the slurry to accelerate in the direction of rotation of the wafer. Of course, the acceleration will be most dramatic at the interface between slurry 116 and polished surface 120 of wafer 112, with the acceleration diminishing with increasing depth within the slurry as measured from the polished surface. The rate of diminishment of the acceleration will depend upon various properties of slurry 116, such as its dynamic viscosity. This phenomenon is an established aspect of fluid mechanics referred to as the "boundary layer."

Polisher 100 may include a platen 124 on which polishing pad 104 is mounted. Platen 124 is rotatable about a rotational axis 128 by a platen driver (not shown). Wafer 112 may be supported by a wafer carrier 132 that is rotatable about a rotational axis 136 parallel to, and spaced from, rotational axis 128 of platen 124. Wafer carrier 132 may feature a gimbaled linkage (not shown) that allows wafer 112 to assume an aspect very slightly non-parallel to polishing layer 108, in which case rotational axes 128, 136 maybe very slightly askew. Wafer 112 includes polished surface 120 that faces polishing layer 108 and is planarized during polishing. Wafer carrier 132 may be supported by a carrier support assembly (not shown) adapted to rotate wafer 112 and provide a downward force F to press polished surface 120 against polishing layer 108 so that a desired pressure exists between the polished surface and the polishing layer during polishing. Polisher 100 may also include a slurry inlet 140 for supplying slurry 116 to polishing layer 108.

As those skilled in the art will appreciate, polisher 100 may include other components (not shown) such as a system controller, slurry storage and dispensing system, heating system, rinsing system and various controls for controlling various aspects of the polishing process, such as: (1) speed controllers and selectors for one or both of the rotational rates of wafer 112 and polishing pad 104; (2) controllers and selectors for varying the rate and location of delivery of slurry 116 to the pad; (3) controllers and selectors for controlling the magnitude of force F applied between the wafer and pad, and (4) controllers, actuators and selectors for controlling the location of rotational axis 136 of the wafer relative to rotational axis 128 of the pad, among others. Those skilled in the art will understand how these components are constructed and implemented such that a detailed explanation of them is not necessary for those skilled in the art to understand and practice the present invention.

During polishing, polishing pad 104 and wafer 112 are rotated about their respective rotational axes 128, 136 and slurry 116 is dispensed from slurry inlet 140 onto the rotating polishing pad. Slurry 116 spreads out over polishing layer 108, including the gap beneath wafer 112 and polishing pad 104. Polishing pad 104 and wafer 112 are typically, but not necessarily, rotated at selected speeds between 0.1 rpm and 150 rpm. Force F is typically, but not necessarily, of a magnitude selected to induce a desired pressure of 0.1 psi to 15 psi (6.9 to 103 kPa) between wafer 112 and polishing pad 104.

As mentioned above, the present invention includes polishing pads having groove configurations designed with consideration of the rotation rates of the polishing pads or wafers being polished, or both, so as to optimize the respective polishing processes in which the pads will be used.

Generally, the design of the various groove configurations is based upon the behavior of slurry 116 within and outside of a backmixing region of polishing layer 10 in which backmixing can occur under the conditions discussed above. Backmixing is relevant to CMP because the polish rate, i.e., the removal rate of material from polished surface 120 of wafer 112 at a point depends on the concentration of active chemistry within slurry 116, and a backmixed region will have a different steady-state active chemistry concentration than an un-backmixed region.

Figure 2A:
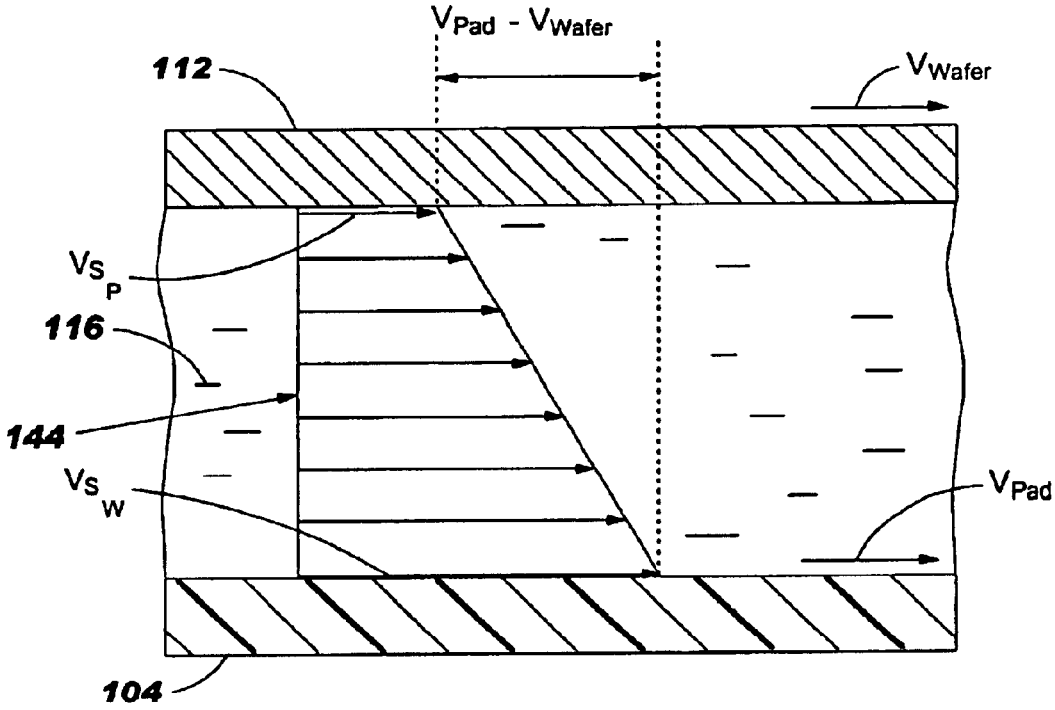
FIG. 2A is a cross-sectional view of the wafer and polishing pad of FIG. 1 illustrating the velocity profile within a region of the slurry layer wherein backmixing is not present.

In order to illustrate the concept of backmixing, FIG. 2A shows a velocity profile 144 of the tangential velocity (with respect to polishing pad 104) in slurry 116 between wafer 112 and the pad under conditions wherein backmixing is not present. The direction of rotation of wafer 112 depicted in velocity profile 144 is generally the same as the rotational direction of polishing pad 104, but the magnitude of the wafer velocity $V_{S_W}$ in slurry 116 proximate the wafer is lower than the tangential velocity $V_{S_P}$ in the slurry proximate the pad. When steady state is reached, the difference in velocities $V_{S_W}$, $V_{S_P}$, of slurry immediately adjacent wafer 112 and immediately adjacent polishing pad 104 is substantially equal to the tangential pad velocity $V_{pad}$ minus the tangential wafer velocity $V_{wafer}$ at the respective points of the wafer and pad under consideration.

Figure 2B:
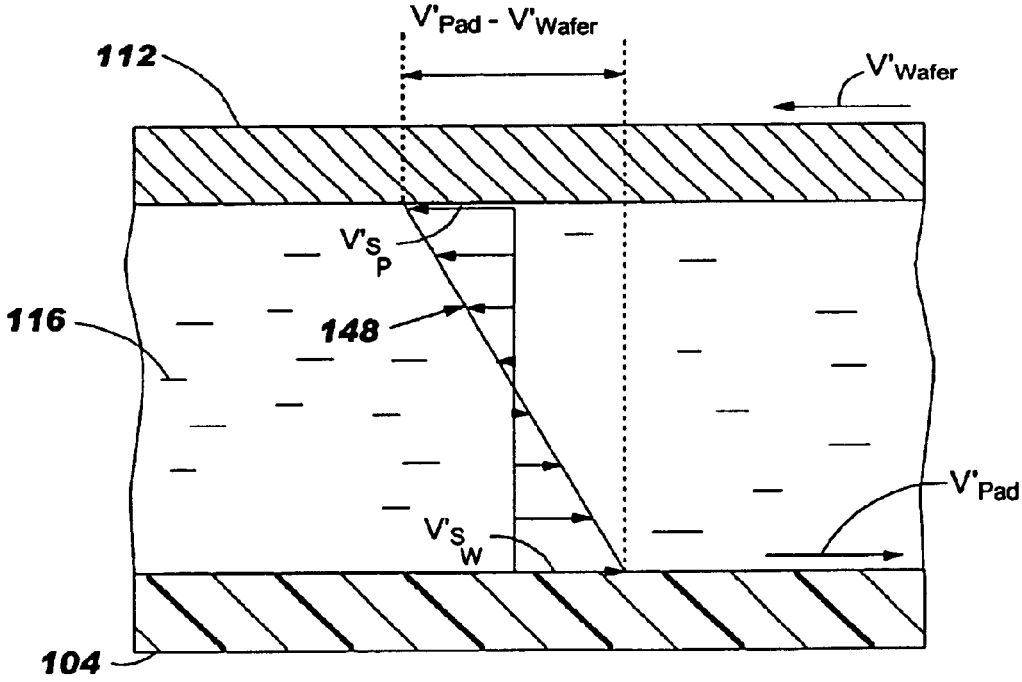
FIG. 2B is a cross-sectional view of the wafer and polishing pad of FIG. 1 illustrating the velocity profile within a region of the slurry layer wherein backmixing is present.

FIG. 2B, on the other hand, illustrates a velocity profile 148 of the tangential velocity, again with respect to polishing pad 104, in slurry 116 between wafer 112 and the pad under conditions that create backmixing. Here, the tangential wafer velocity $V'_{wafer}$ is in a direction opposite the tangential pad velocity $V'_{pad}$ and has a magnitude greater than the magnitude of the tangential pad velocity $V'_{pad}$. Accordingly, the difference $V'_{pad}-V'_{wafer}$ is negative, as indicated by the velocity $V'_{s_w}$ in slurry 116 adjacent wafer 112 being in a direction opposite the velocity $V'_{S_P}$ in the slurry adjacent polishing pad 104. When velocities $V'_{S_W}$, $V'_{S_P}$ are opposite one another, backmixing is said to be occurring, since the upper portion of slurry 116 is being driven "back" by wafer 112, i.e., at least partially in a direction opposite the direction of the movement of polishing pad 104 and the slurry proximate the pad.

Figure 3:
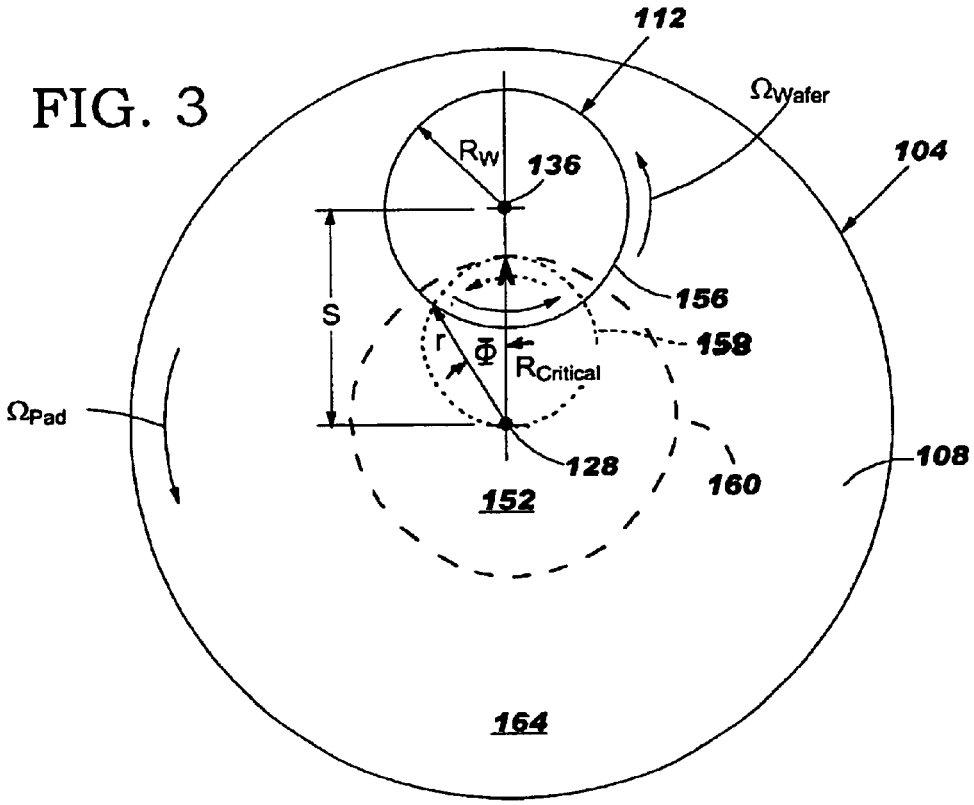
FIG. 3 is a plan view of the wafer and polishing pad of the polisher of FIG. 1 illustrating the presence of a slurry backmixing region on the polishing layer of the polishing pad.

Referring to FIG. 3, backmixing slows the infusion of fresh slurry into the gap between wafer 112 and polishing pad 104 in backmixing region 152 relative to the infusion of fresh slurry when backmixing is not present. Similarly, when backmixing is present, spent slurry has a longer residence time within the gap than when backmixing is not present, since backmixing drives a portion of spent slurry backwards against the direction polishing pad 104 is moving. As those skilled in the art will recognize, removal rates for CMP are typically described by the following "Preston" equation:

$$\text{Removal Rate}=K_{chem}(K_{mech})P[V_{pad-wafer}] \quad \{1\}$$

that expresses the removal rate of material from the polished surface of wafer 112 as a function of the relative velocity between the wafer and pad ($V_{pad-wafer}$), the pressure P between the wafer and pad, a parameter $K_{chem}$ relating to removal of material from the wafer by chemical action, and a parameter $K_{mech}$ relating to removal of the wafer material by mechanical action. When backmixing is present, the concentration of chemical species is different at different locations under wafer 112, leading to non-uniform polish rates across wafer 112.

Computational fluid dynamics simulations reveal that at the leading edge 156 of wafer 112 (relative to the rotation of polishing pad 104) the slurry attempting to enter backmixing region 152 is driven away more strongly in areas where grooves (not shown) in the pad are aligned with the pad rotation. Held among the "asperities," or surface texture, of polishing layer 108, slurry in the land areas between the grooves is conveyed more effectively by the rotation of polishing pad 104 against the drag of the reverse movement of wafer 112 than slurry in the grooves. Transient simulation of fresh slurry infusing under wafer 112 and replacing spent slurry shows a mixing wake in the grooves that is much longer in backmixing region 152 than elsewhere.

Solving the theoretical fluid mechanics (Navier-Stokes) equations for the flow patterns in the pad-wafer gap leads to a formula that relates the extent of backmixing region 152 to two parameters: (1) the separation distance (S) between rotational axis 128 of polishing pad 104 and rotational axis 136 of wafer 112, and (2) the ratio of the rotational speeds $\Omega_{pad}$, $\Omega_{wafer}$ of the pad and wafer. For a wafer of radius $R_{wafer}$, if the rotational speeds $\Omega_{pad}$, $\Omega_{wafer}$ of polishing pad 104 and wafer 112 are such that $$\frac{\Omega_{pad}}{\Omega_{wafer}} < \frac{R_{wafer}}{S - R_{wafer}} \quad \{2\}$$

then slurry backmixing occurs in that portion of the circle 158 defined by $$r(\sec\phi) = \frac{S}{1 + \frac{\Omega_{pad}}{\Omega_{wafer}}} \quad \{3\}$$

lying within the perimeter of the wafer. As polishing pad 104 rotates, the circle 158 defined by equation {3} sweeps out a circle 160 within which the pad passes through the backmixing region under wafer 112. Outside of circle 160 the pad does not pass through the backmixing region under wafer 112. The critical radius of the circle 160 is $$R_{critical} = \frac{S}{1 + \frac{\Omega_{pad}}{\Omega_{wafer}}} \quad \{4\}$$

Separation distance S is typically (but not necessarily) approximately fixed on CMP polishers, although there is often a small side-to-side oscillation of wafer 112 amounting to less than a 10% variation in the separation distance S. Thus, in general, for a given polisher, there will be a critical pad-to-wafer rotation ratio below which backmixing occurs. Correspondingly, for a given pad-to-wafer rotation ratio that is below the backmixing limit, there will be a critical radius $R_{critical}$ measured from rotational axis 128 of polishing pad 104 that generally defines a boundary 160 between backmixing region 152 and non-backmixing region 164. Within boundary 160, it can be disproportionately difficult to replace spent slurry with fresh slurry when replacement is desired and disproportionately difficult to remove polishing byproducts when replacement is desired. It is noted that when wafer 112 is laterally oscillated in addition to being rotated, two critical radii (not shown) are present. These critical radii correspond to the two extremes of the oscillation of wafer 112 in a radial direction relative to polishing pad 104. Providing an $R_{critical}$ equal to 0.5 to 2 times the critical radius calculated using equation {4} improves polishing performance. Preferably, the $R_{critical}$ is equal to 0.75 to 1.5 times the critical radius calculated using equation {4}. Most preferably, the $R_{critical}$ is equal to 0.9 to 1.1 times the critical radius calculated using equation {4}.

In general, the effect of backmixing on polish performance may be either desirable or undesirable, depending on the material being polished and the slurry chemistry. For many processes, the removal rate of material from polished surface 120 (FIG. 1) of wafer 112 will decrease in the presence of spent slurry so as to increase non-uniformity, and polish debris may accumulate in the more slowly renewed region, thereby raising the probability of increased defectivity (e.g. macro-scratches). However, other processes, e.g., CMP of copper, proceed via kinetics that may be enhanced when a minimum concentration of polish byproducts is present to sustain some or all of the chemical reactions necessary for polishing to occur. In these processes, the absence of any backmixing will impede the polishing chemical reactions and manifest in a much lower removal rate below the backmixing limit.

Generally, the present invention includes providing a first groove configuration to polishing layer 108 within backmixing region 152 wherein backmixing can occur under the conditions discussed above and, optionally, providing a second groove configuration in the polishing layer to non-backmixing region 164 where backmixing typically does not occur. As discussed below, the present invention also provides a method of determining the location of the backmixing region of a polishing pad, e.g., backmixing region 152 of rotational polishing pad 104, as a function of the contemplated, or predetermined, rotational speed $\Omega_{wafer}$ of wafer 112 and the contemplated, or predetermined, speed, e.g., rotational speed $\Omega_{pad}$ of the pad.

For processes impaired by slow or incomplete removal of polish byproducts, the present invention includes providing polishing layer 108 within backmixing region 152 of polishing pad 104 with a first groove configuration (not shown) containing a plurality of grooves that provide the slurry with a relatively low resistance to flow out of the backmixing region so that the movement of the pad or wafer 112, or both, acts or act to facilitate the removal of spent slurry from the backmixing region. The grooves of the first groove configuration may achieve such low resistance to flow by virtue of, among other things, their number, longitudinal shape, orientation or cross-sectional area, or a combination of these. Non-backmixing region 164 may optionally include a second groove configuration (not shown) that is different from the first groove configuration. The second groove configuration may include a plurality of grooves that differ from the grooves of the first groove configuration in any one or more of number, longitudinal shape, orientation, cross-sectional area and combinations of these, among other things. The second groove configuration may be designed to achieve any one or more purposes selected by the designer. For example, the second groove configuration may provide non-backmixing region 164 with a relatively high resistance to slurry flow, superior slurry utilization capability and enhanced slurry distribution, among other things.

Figure 4A:
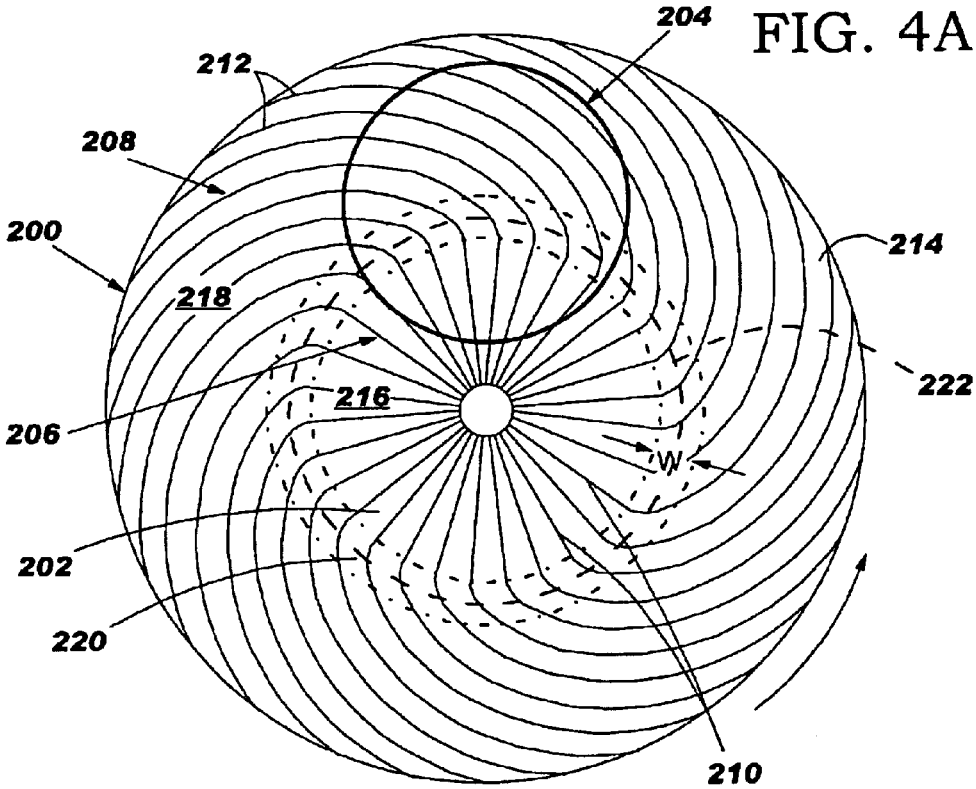
FIGS. 4A, 4B and 4C are each a plan view of a rotational polishing pad of the present invention having a groove configuration for CMP processes in which the presence of spent slurry is detrimental to polishing.
Figure 4B:
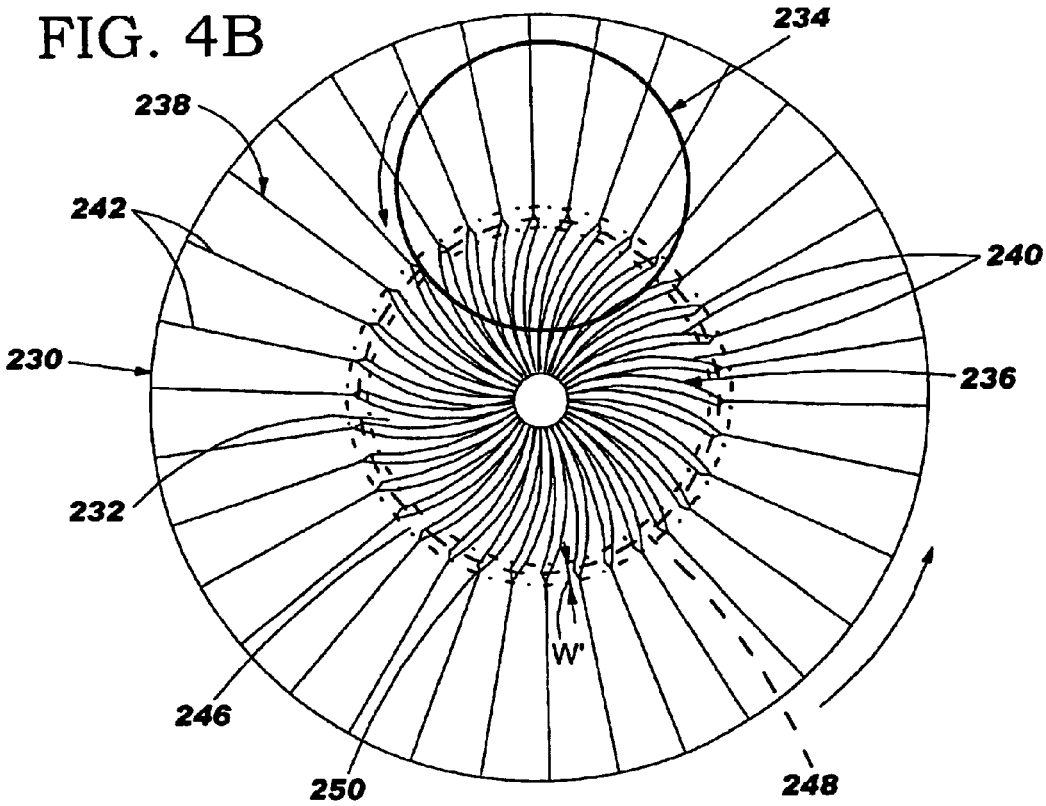
Figure 4C:
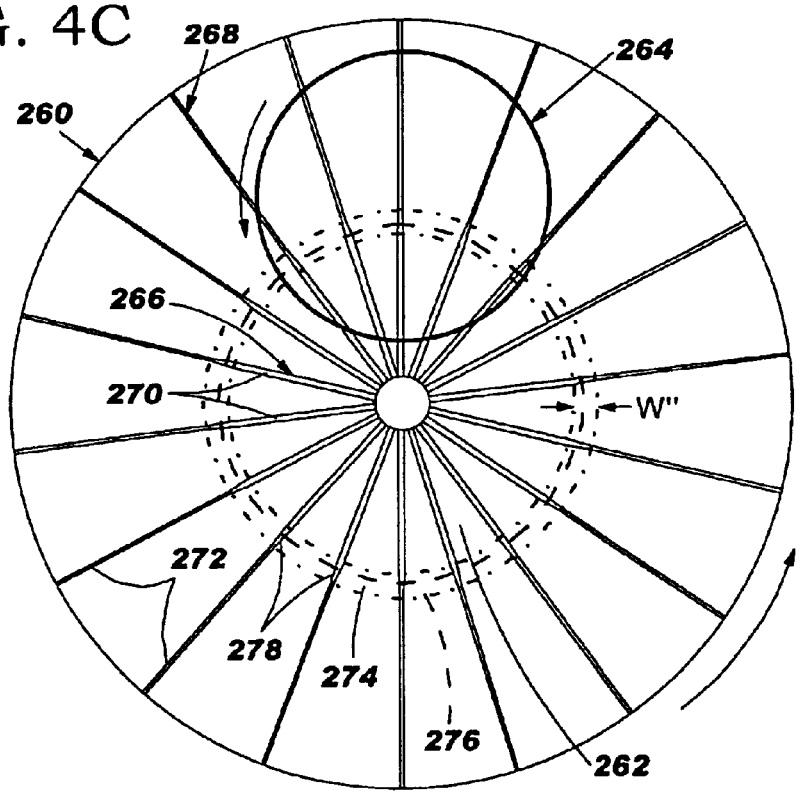

FIGS. 4A–4C show exemplary rotary polishing pads 200, 230, 260 that include various groove configurations designed in accordance with the present invention for processes in which the presence of spent slurry in each backmixing region 202, 232, 262 is detrimental to polishing of corresponding wafers 204, 234, 264. FIG. 4A illustrates polishing pad 200 of the present invention wherein first groove configuration 206 and second groove configuration 208 differ from one another primarily by the longitudinal shapes and orientations of grooves 210, 212 in the respective regions of polishing layer 214. Grooves 210 of first groove configuration 206 within backmixing region 216 may be straight and radiate outward from the center of polishing pad 200. This configuration enhances the removal of spent slurry from backmixing region 216 by providing channels transverse to the direction of pad rotation that move slurry in the manner of a positive displacement pump or conveyer and reduce the impact of the reverse rotation of the wafer.

On the other hand, grooves 212 of second groove configuration 208 of non-backmixing region 218 may be any longitudinal shape or have any orientation, or both, other than the longitudinal shape and orientation of grooves 210 of first groove configuration 206. In the present example, grooves 212 may have any longitudinal shape and orientation other than straight and radial, such as the curved longitudinal shape that generally curves in the design rotational direction of polishing pad 200. Such a groove configuration tends to slow the radial flow of slurry within non-backmixing region 218 and increase the retention time of the slurry upon polishing pad 200. Of course, grooves 212 may have any one of any number of longitudinal shapes, such as circular, wavy or zigzag, to name a few, and may have any one of a number of other orientations relative to polishing pad 200, such as extending radially, counter to the direction of pad rotation or in a grid pattern, among others. Again, those skilled in the art will appreciate that many variations of longitudinal shapes and orientations exist for grooves 210, 212 of each one of first and second groove configurations 206, 208.

When one or more grooves 210 of first groove configuration 206 are connected to one or more corresponding grooves 212 of second groove configuration 208, polishing layer 214 may include a transition region 220 in which such connection occurs. Transition region 220 may generally have any width W necessary for the transition. Depending upon first and second configurations 206, 208, width W of transition region 220 may be zero for an abrupt transition. As discussed above, outer boundary 220 of backmixing region 216 may be defined by one or two critical radii $R_{critical}$ (depending on whether or not wafer 204 is oscillated in addition to being rotated) that may be determined using Equation {4}, above, and the pad-to-wafer rotation ratio and separation distance S (FIG. 3) of the polisher under consideration.

FIG. 4B illustrates polishing pad 230 of the present invention wherein first groove configuration 236 differs from second groove configuration 238 primarily by the number of grooves 240, 242 in each group, but also (optionally) in longitudinal shape and orientation. Each groove 240 in first groove configuration 236 may, but not necessarily, have substantially the same transverse cross-sectional shape and area as each groove 242 in second groove configuration 238. In the embodiment shown, first groove configuration 236 has twice the number of grooves 240 than the number of grooves 242 in second groove configuration 238. Consequently, when the transverse cross-sectional areas of each of grooves 240, 242 are the same as one another, first groove configuration 236 provides twice the flow channel area than second groove configuration 238 to aid in the removal of spent slurry from backmixing region 232. It is also noted that the generally radial orientation of grooves 240 of first groove configuration 236 and their curvature in a direction generally opposite the design rotational direction of polishing pad 230 may further assist in the removal of spent slurry from backmixing region 232. Transition region 246 generally contains outer boundary 248 of backmixing region 232 and has a width W' that accommodates branched groove segments 250 that connect pairs of adjacent grooves 240 of first groove configuration 236 to corresponding respective ones of grooves 242 of second groove configuration 238.

FIG. 4C illustrates polishing pad 260 of the present invention having a first groove configuration 266 within backmixing region 262 that differs from second groove configuration 268 outside of backmixing region 262 primarily by the cross-sectional areas of the respective grooves 270, 272. Although grooves 270 of first groove configuration 266 are straight and radial like grooves 272 of second groove configuration 268 and have the same depth as the grooves of the second groove configuration, each groove in the first groove configuration is wider than each groove of the second groove configuration. Consequently, first groove configuration 266 provides a channel flow area that is greater than the channel flow area of second groove configuration 268. The greater channel flow area within backmixing region 262 enhances the removal of spent slurry from the backmixing region relative to the removal of spent slurry from the backmixing region that would occur if grooves 270, 272 of first and second groove configurations 266, 268 had the same transverse cross-sectional areas as each other. In the embodiment shown, transition region 274 contains outer boundary 276 of backmixing region 262 and has a width W" to accommodate a gradual transition 278 in the transverse cross-sectional areas between corresponding respective ones of grooves 270, 272.

Figure 5:
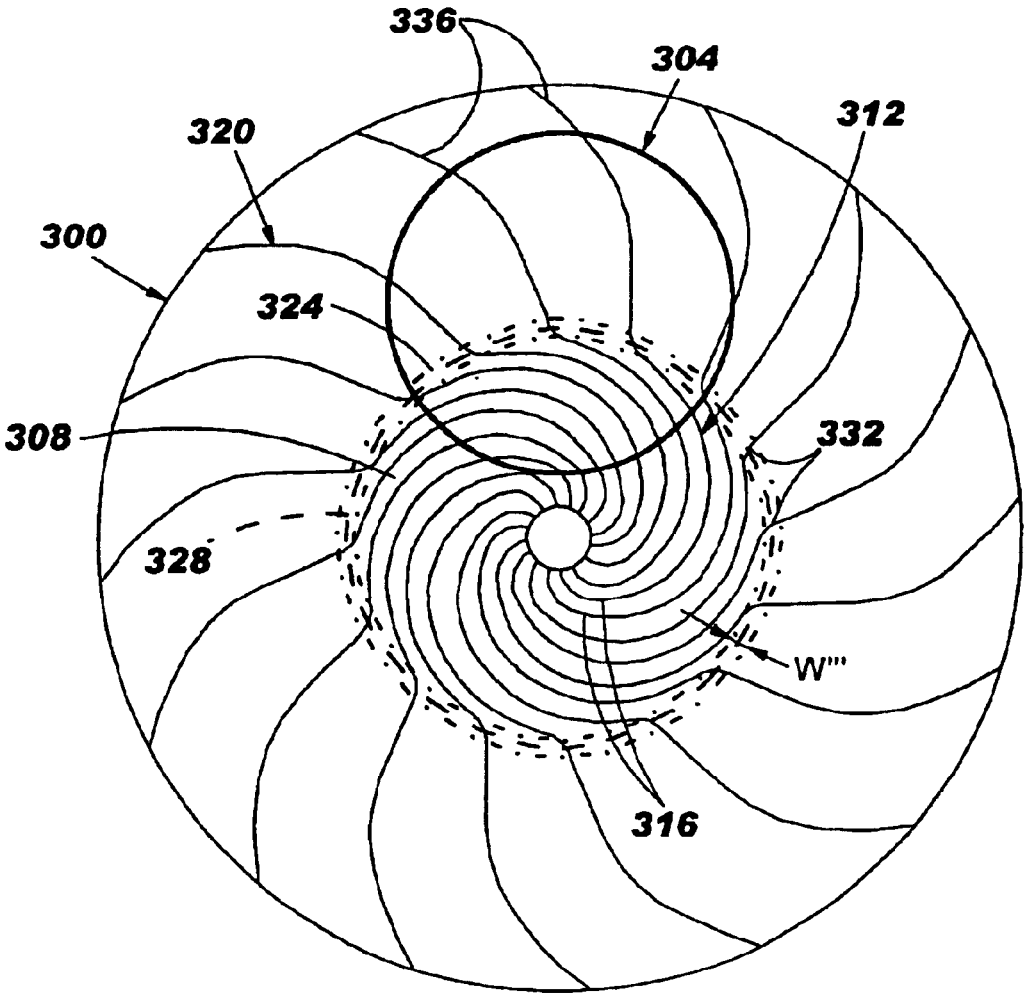
FIG. 5 is a plan view of a rotational polishing pad of the present invention having a groove configuration for CMP processes in which polishing byproducts are beneficial to polishing.

Whereas FIGS. 4A–4C illustrate various polishing pads 200, 230, 260 designed for processes in which the presence of spent slurry can be detrimental to polishing, FIG. 5 illustrates a polishing pad 300 designed for processes wherein one or more polish byproducts are beneficial to polishing, e.g., to sustain some or all of the chemical reactions necessary for removal of material from a wafer 304. CMP of copper is a notable example of a process that may benefit from the presence of polish byproducts. Where one or more polishing byproducts are beneficial to polishing, it can be desirable to increase the residence time of the "spent" slurry within backmixing region 308 in order to extend the time the byproduct(s) in the spent slurry is/are available for polishing. One way to accomplish this is to provide backmixing region 308 with a first groove configuration 312 having grooves 316 that inhibit the removal of spent slurry from the backmixing region. Substantially tangential grooves 316 that curve in the rotational direction of polishing pad 300 provide a groove configuration that inhibits the removal of spent slurry from backmixing region 308. Of course, other inhibiting groove configurations are possible.

Similar to second groove configurations 208, 238, 268 discussed above in connection with processes wherein the presence of spent slurry is detrimental to polishing, second groove configuration 320 outside of backmixing region 308 may be any suitable configuration other than first groove configuration 312, such as the generally radial, curved configuration shown. In the embodiment shown, transition region 324 contains outer boundary 328 of backmixing region 308 and has a width W'" that accommodates groove segments 332 that provide a transition between grooves 316 of first groove configuration 312 and grooves 336 of second groove configuration 320. Although first and second groove configurations 312, 320 are shown as differing primarily in the longitudinal shapes and orientations of the respective grooves 316, 336, the grooves may differ in additional or alternative ways, such as by number and cross-sectional area, or both, among others, in a manner similar to the manner discussed above in connection with polishing pads 200, 230, 260 of FIGS. 4A–4C designed for processes in which spent slurry can be detrimental to polishing.

Figure 6A:
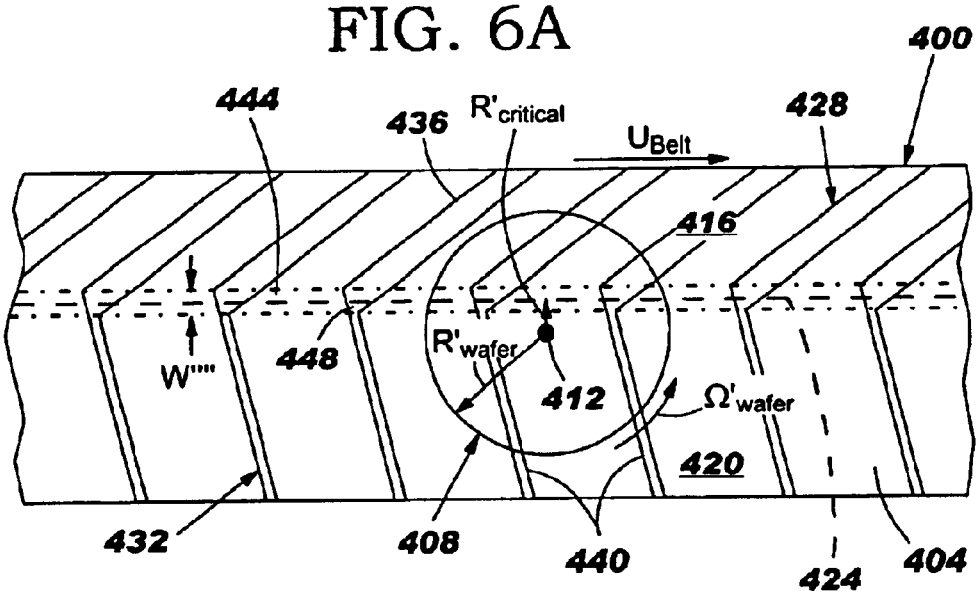
FIG. 6A is a plan view of a polishing belt of the present invention having a groove configuration for CMP processes in which polishing byproducts are beneficial to polishing.

Although the present invention has been described above in the context of rotary polishers, those skilled in the art will understand that the present invention may be applied in the context of other types of polishers, such as linear belt polishers. FIG. 6A shows a polishing belt 400 of the present invention having a polishing layer 404 operatively configured for polishing a wafer 408, or other article, rotated at a rotational speed $\Omega'_{wafer}$ about a rotational axis 412 generally in contact with the polishing layer in the presence of a slurry (not shown), or other polishing medium, while the polishing layer is moved at a linear velocity $U_{belt}$ relative to the rotational axis of the wafer.

Backmixing of slurry can occur under a portion of wafer 408 where a component of the tangential velocity of the wafer is in a direction opposite the linear velocity $U_{belt}$ of polishing belt and the rotational speed $\Omega'_{wafer}$ of the wafer is greater than $\Omega'_{wafer\ critical}$, where:

$$\Omega'_{wafer_{critical}} = \frac{U_{belt}}{R'_{wafer}} \quad \{5\}$$

Consequently, depending upon the ratio of the linear velocity $U_{belt}$ of polishing belt 400 to the rotational speed $\Omega'_{wafer}$ of wafer 408 and the radius $R'_{wafer}$ of the wafer (all of which are typically predetermined), polishing layer 404 will have a backmixing region 416 in which backmixing can occur and a non-backmixing region 420 in which backmixing does not typically occur.

Generally, the location of the boundary 424 between backmixing region 416 and non-backmixing region 420 lies at a distance $R'_{critical}$ measured across the width of the belt from the center of wafer 408 given by:

$$R'_{critical} = \frac{U_{belt}}{\Omega'_{wafer}} \quad \{6\}$$

Thus, like rotary polishing pads 200, 230, 260, 300 of FIGS. 4A–4C and 5, polishing belt 400 of FIG. 6A may have a first groove configuration 428 in backmixing region 416 that is different in one or more respects from a second groove configuration 432 in non-backmixing region 420. In addition, as with the rotary polishing pads discussed above, first groove configuration 428 of polishing belt 400 may be designed to particularly suit the type of polishing process. In this connection, FIG. 6A illustrates polishing belt 400 of the present invention having first groove configuration 428 designed for processes in which polishing benefits from the presence of polish byproducts in the backmixing region. In this case, as with rotary polishing pads, it is desirable to provide backmixing region 416 with grooves 436 that retard the removal of spent slurry from the backmixing region. Grooves that suit this purpose include grooves 436 shown that are relatively wide and generally oriented at a relatively small angle relative to longitudinal boundary 424. In contrast to the analogous groove configuration of FIG. 4C, the orientation of grooves 436 when used with the direction of belt movement indicated in FIG. 6A resist the flow of slurry outward to the edge of polishing belt 400. Other grooves include grooves that are parallel to boundary 424, among others. Second groove configuration 432 may contain any configuration of grooves 440 other than the configuration of first groove configuration 428. For example, grooves 440 may be relatively narrow and angled as shown. Further, grooves 440 may be another shape, such as wavy, zigzag or curved, among others, to suit a particular design. Like the rotary polishing pads discussed above, grooves 440 of second groove configuration 432 may differ from grooves 436 of first groove configuration 428 in any one or more of the following ways: by number; cross-sectional area; longitudinal shape; and orientation relative to longitudinal boundary 424, among others. In addition, polishing belt 400 may include a transition zone 444 that contains boundary 424 and has a width W“ ” suitable for containing transitions 448 between grooves 436 and grooves 440.

Figure 6B:
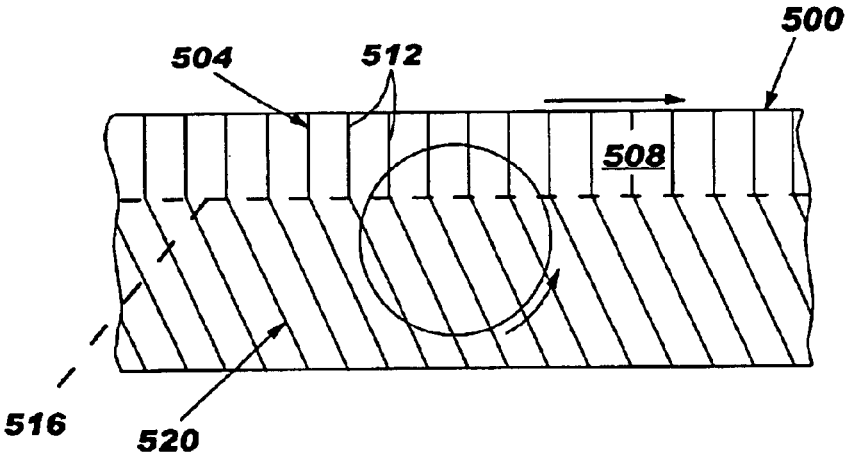
FIG. 6B is a plan view of a polishing belt of the present invention having a groove configuration for CMP processes in which the presence of spent slurry is detrimental to polishing.

FIG. 6B, on the other hand, illustrates a polishing belt 500 of the present invention having a first groove configuration 504 in backmixing region 508 designed for processes in which the presence of spent slurry in backmixing region 508 can be detrimental to polishing. Accordingly, grooves 512 of first groove configuration 504 are configured so as to enhance the removal of spent slurry from backmixing region 508 by providing channels transverse to the direction of belt movement that move slurry in the manner of a positive displacement pump or conveyer and reduce the impact of the reverse rotation of the wafer. Many other configurations are possible. Second groove configuration 520 may be any configuration other than first groove configuration 504, along the lines discussed above in connection with rotary polishing pads 200, 230, 260, 300 and polishing belt 400.

What is claimed is:

1. A polishing pad for polishing an article rotated at a predetermined first rotational rate about a first rotational axis, comprising:

(a) a polishing layer operatively configured to be moved at a predetermined rate relative to the first rotational axis, the polishing layer comprising:

(i) a boundary located at 0.5 to 2 times the critical radius calculated as a function of the predetermined first rotational rate of the article and the predetermined rate of the polishing layer, the boundary having a first side and a second side opposite the first side;

(ii) a first set of grooves located on the first side of the boundary and having a first configuration; and (iii) a second set of grooves located on the second side of the boundary and having a second configuration different from the first configuration.

2. The polishing pad according to claim 1, wherein at least some of the grooves in the first set of grooves are connected to corresponding respective grooves of the second set of grooves across the boundary.

3. The polishing pad according to claim 1, wherein the polishing layer is circular in shape and is rotatable about a second rotational axis in a predetermined direction and the predetermined rate of the polishing layer is a predetermined second rotational rate about the second rotational axis.

4. The polishing pad according to claim 3, wherein the first set of grooves is located proximate the second rotational axis and contains grooves that are substantially tangent to the predetermined direction.

5. The polishing pad according to claim 3, wherein the first set of grooves is located proximate the second rotational axis and contains grooves that are substantially radial relative to the polishing layer.

6. The polishing pad according to claim 1, wherein the polishing layer is elongate and the predetermined rate of the polishing layer is a linear velocity.

7. A method of making a polishing pad having a polishing layer for polishing an article rotated at a predetermined first rotational rate about a first rotational axis while the polishing layer is moved at a predetermined rate relative to the first rotational axis, the method comprising the steps of:

(a) determining the location of a boundary on the polishing layer at 0.5 to 2 times the critical radius calculated as a function of the predetermined first rotational rate of the article and the predetermined rate of the polishing layer;

(b) providing a first set of grooves of a first configuration to the polishing layer on a first side of the boundary; and (c) providing a second set of grooves of a second configuration different from the first configuration on a second side of the boundary opposite the first side.

8. The method according to claim 7, further including the step of joining at least some of the grooves of the first set of grooves to corresponding respective grooves of the second set of grooves across the boundary.

9. The method according to claim 7, wherein backmixing of a polishing medium occurs in the first set of grooves.

10. The method according to claim 9, wherein the step of selecting the first configuration includes selecting the first configuration based on the process being one of a type in which polishing byproducts are beneficial to polishing.

* * * * *